United States Patent [19]

Coldren et al.

[11] 4,144,430

[45] Mar. 13, 1979

[54] CANTILEVER SPRING CONTACT HAVING INTEGRAL SUPPORT PIN

[75] Inventors: Daniel R. Coldren, Enola; Benjamin C. Williams, Harrisburg, both of Pa.

[73] Assignee: AMP Incorporated, Harrisburg, Pa.

[21] Appl. No.: 885,144

[22] Filed: Mar. 10, 1978

[51] Int. Cl.[2] ..... H01H 1/24; H01H 1/26; H01H 1/28

[52] U.S. Cl. ..... 200/245; 200/246; 200/247; 200/283; 200/292; 200/159 A

[58] Field of Search ..... 200/159 A, 292, 238, 200/239, 245, 246, 247, 283, DIG. 46

[56] References Cited

U.S. PATENT DOCUMENTS

| | | | |
|---|---|---|---|
| 2,469,650 | 5/1949 | Isserstadt | 200/159 A X |
| 2,470,701 | 5/1949 | Jacobs | 200/159 A X |
| 2,582,131 | 1/1952 | Jorgensen et al. | 200/247 |
| 3,085,139 | 4/1963 | Wright | 200/292 |
| 3,102,939 | 9/1963 | Bauer | 200/245 |
| 3,133,177 | 5/1964 | Alexandersson | 200/245 |
| 3,319,033 | 5/1967 | Claesson et al. | 200/283 |
| 3,433,914 | 3/1969 | Ericsson | 200/159 A |
| 3,497,857 | 2/1970 | Pfaufer | 200/246 |
| 3,558,837 | 1/1971 | Bayer, Jr. | 200/159 A |
| 3,883,704 | 5/1975 | Barney | 200/50 C X |
| 3,903,381 | 9/1975 | Diehr | 200/50 C |
| 4,010,339 | 3/1977 | Owen et al. | 200/292 |

*Primary Examiner*—Henry K. Artis
*Attorney, Agent, or Firm*—Frederick W. Raring

[57] ABSTRACT

A spring contact which is intended to be mounted on a circuit board comprises an elongated spring blade having a mounting end and an outer or free end. An integral mounting plate extends alongside the blade from the mounting end thereof to an intermediate location. A mounting pin is formed at the mounting end by two laterally extending leg portions, one on the spring blade and the other on the mounting plate, and a support pin extends from the mounting plate in spaced relationship to the mounting pin. The mounting plate has laterally extending support flanges which support the device on the printed circuit board when it is inserted into openings in the board. The spring contacts are manufactured as a continuous strip and can be inserted into circuit boards by automatic insertion machines.

10 Claims, 6 Drawing Figures

CANTILEVER SPRING CONTACT HAVING INTEGRAL SUPPORT PIN

BACKGROUND OF THE INVENTION

This invention relates to spring contacts of a type which are commonly used on circuit boards of touch switch selector telephone instruments. Other uses for spring contacts in accordance with the invention, will be apparent from the following description.

The touch switch telephone number selector units of the type which are currently being manufactured have a circuit board located in back of the panel on which the individual digit selector switch buttons are located and this circuit board has mounted thereon a plurality of spring contacts which extend past fixed contact pins mounted in the circuit board. Each time one of the individual switch buttons is pressed to select a digit when a number is being called, all of these switches are flexed by a mechanism which engages the ends of the spring contacts and moves them towards or away from their associated contact pins. Obviously, the spring contact which is used on circuit boards under these conditions must be capable of a vast number of cycles of flexure without failure, for the reason that telephone instruments are designed to yield many years of service and the springs will be flexed several times when each number is selected and a call is being made.

At present, these circuit boards are manufactured by inserting a mounting pin into the circuit board and thereafter spot welding a spring contact blade to the mounting pin. It is also necessary to insert a separate support pin adjacent to the mounting pin which serves to support the spring blade during flexure. While present manufacturing processes produce spring contacts which have the requisite reliability and satisfy all electrical requirements, the manufacturing cost is relatively high because of the fact that two insertion operations and one assembly operation (the welding of the spring contact to the mounting pin) are required for each spring contact. The instant invention is directed to the achievement of an improved spring contact which will satisfy all the electrical and mechanical requirements of the application and which will result in a substantial reduction in manufacturing cost.

In accordance with the principles of the instant invention, the spring contact is manufactured by stamping and forming a strip of suitable spring metal so that the contacts can be fed to an insertion machine and automatically inserted into the circuit board. The individual spring contacts comprise an elongated spring blade having a mounting plate portion integral therewith at one end thereof. The mounting plate portion extends partially along the length of the blade and has at one end thereof an integral supporting pin which is intended to be mounted in the circuit board and to support the spring blade when the contact is flexed. A mounting pin is provided at one end of the spring blade which consists of laterally extending legs on the blade itself and on the mounting plate. In addition, supporting flanges are provided on the mounting plate which bear against the surface of the circuit board when the contact is inserted into the holes in the circuit board. The supporting flanges serve to protect the spring contact in the event that any downward force is imposed on the contact after insertion.

It is accordingly an object of the invention to provide an improved spring contact having integral mounting means for mounting on a circuit board. A further object is to provide an improved spring contact in continuous strip form. A further object is to provide a contact having an integral support pin which serves to support the blade during flexure.

These and other objects of the invention are achieved in a preferred embodiment thereof which is briefly described in the foregoing abstract, which is described in detail below and which is shown in the accompanying drawing in which:

FIG. 3 is a fragmentary perspective view showing a portion of a circuit board having spring contacts in accordance with the invention mounted thereon.

Figure 1:
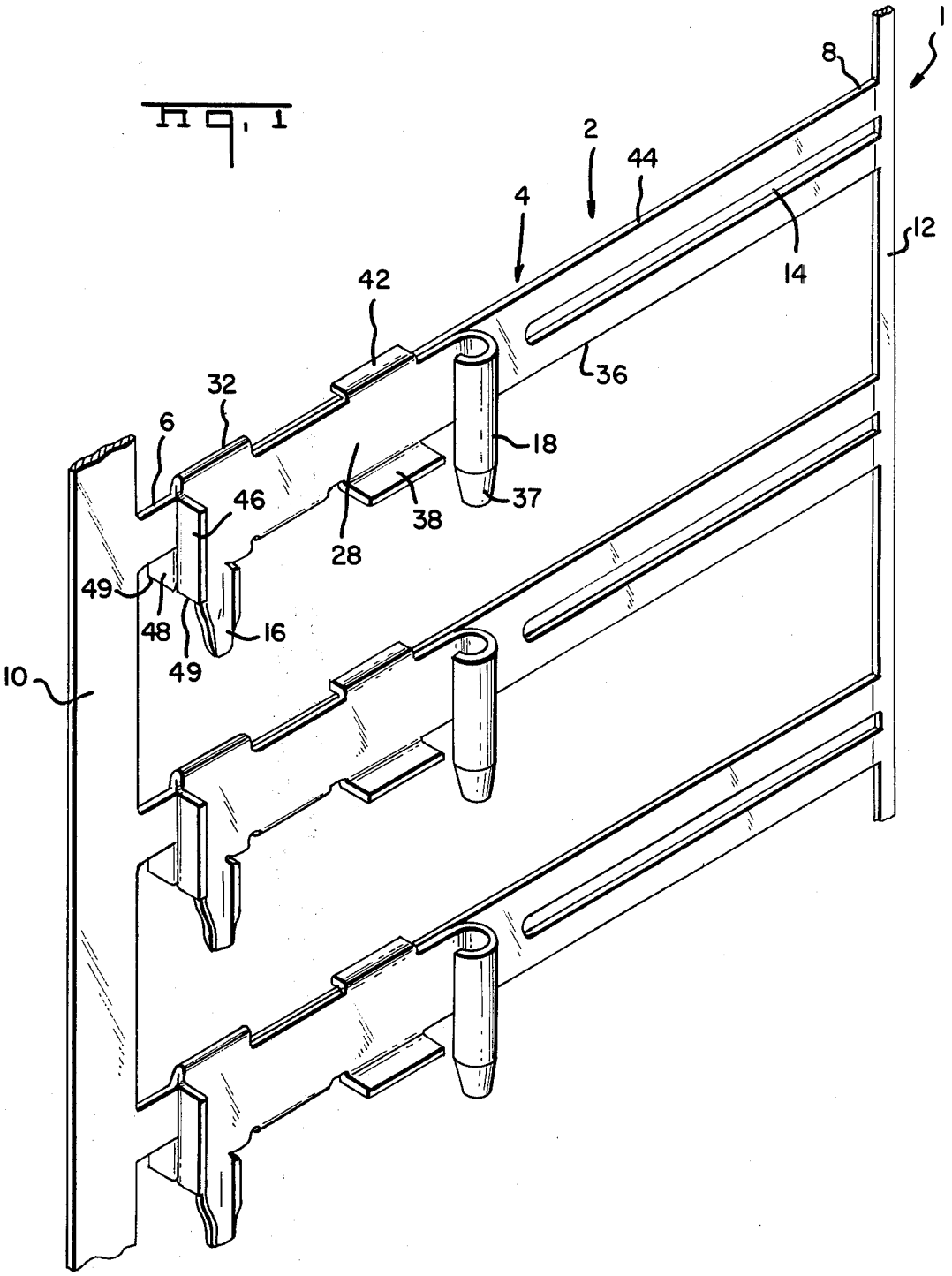
FIG. 1 is a perspective view of a portion of a continuous strip of spring contacts in accordance with the invention.
Figures 1, 2:
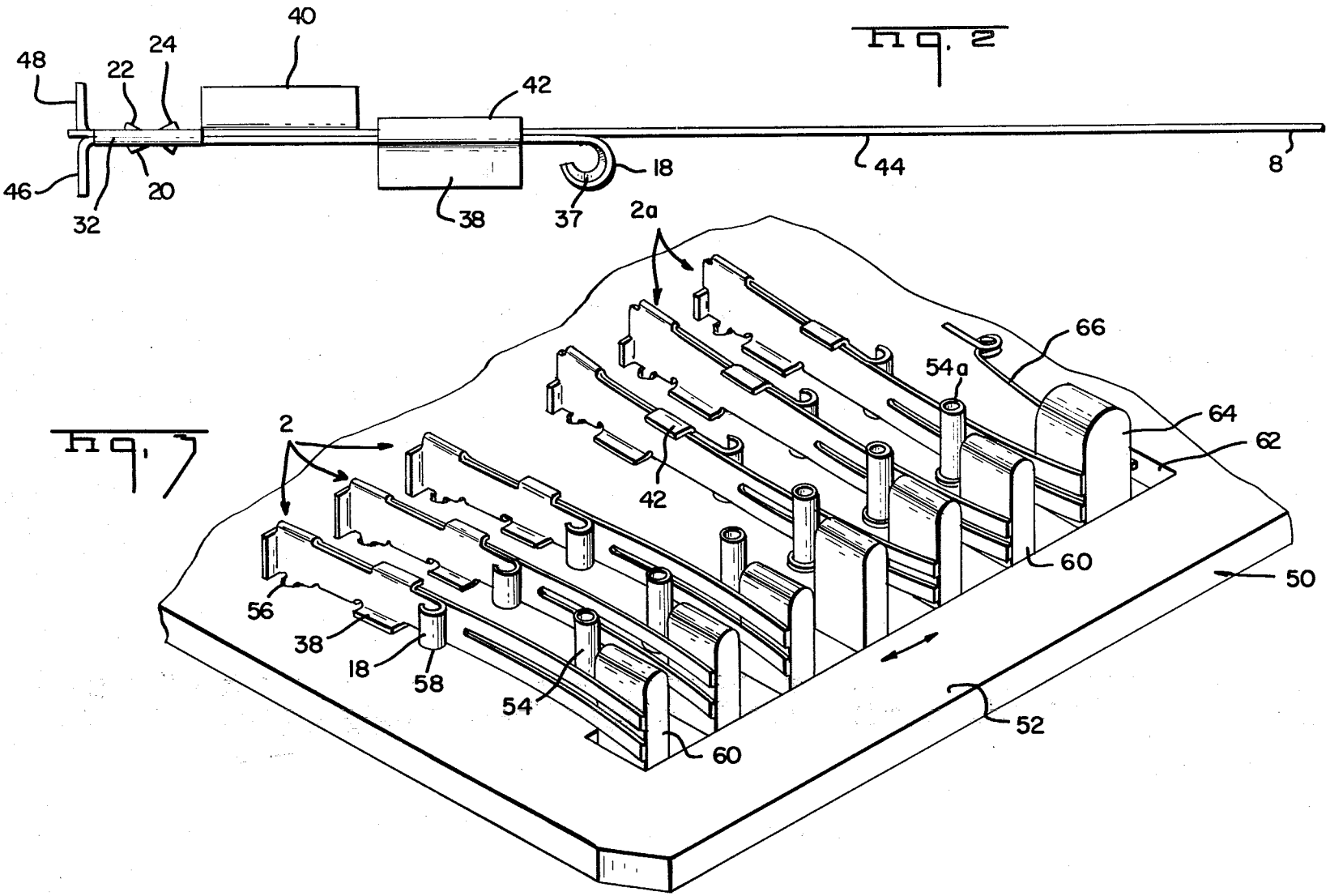
FIG. 2 is a top plan view of a spring contact in accordance with the invention.

Referring first to FIGS. 1 and 2, a continuous strip 1 in accordance with the invention comprises spaced-apart carrier strips 10, 12 having a plurality of spring contacts 2 integral therewith and extending between the carrier strips at regularly spaced intervals. Each spring contact 2 comprises an elongated generally rectangular spring blade 4 having an inner end or mounting end 6 which is integral with carrier strip 10 and an outer end 8 which is integral with carrier strip 12. An elongated opening 14 is provided in the blade and extends to the end 8 thereof so that redundant contacts will be obtained when the contact is placed on a circuit board.

The individual spring contacts 2 have integral mounting pin portions 16 and blade support pin portions 18, which are inserted into holes in a circuit board when the contact is mounted on the board. The mounting pin portion 16 is comprised of legs 20, 22 which extend downwardly, as viewed in FIG. 1, adjacent to the carrier strip 10. The leg 20 extends from a mounting plate 28, described below, while the leg 22 extends from the blade 4. Both of these legs are formed into a generally arcuate shape, as shown in FIG. 2, so that they project beyond the surfaces of the contact spring as shown at 24.

The blade support pin 18 is produced by rolling the end portion of the mounting plate 28 and the lower end of the pin is tapered, as shown at 37, thereby to facilitate its entry into a circuit board hole. The mounting plate 28 extends alongside the blade 4 from the mounting end 6 thereof and is connected to the plate by a reverse fold 32, which is located at the inner end of the blade.

The mounting plate 28 extends laterally, or downwardly, beyond the lower edge 36 of the blade 4 and laterally extending support flanges 38, 40 extend from the lower edge of the mounting plate in both directions normally of the plane of the strip, that is, normally of the plane of the blade 4. An additional flange 42 extends from the upper edge of the mounting plate 28 over the upper edge 44 of the blade 4. The flange 42 ensures that the centerline of the blade 4 will extend substantially normally of the axes of the support pin 18 and the mounting pin 16 and that, therefore the blade itself will extend parallel to the surface of a circuit board, as will be described below.

Flanges, as shown at 46, 48, also extend from the rearward edge of the mounting plate 28 and from the rearward end of the blade 4. These flanges lie in a plane which extends normally of the plane of the blade 4 and normally of the plane defined by the flanges 38, 40. The downwardly facing edges 49 of the flanges 46, 48 are coplanar with the downwardly facing surfaces of the flanges 38, 40 so that these edges 49 will also bear against the surface of the board after the contact has been inserted into the board.

Figure 4:
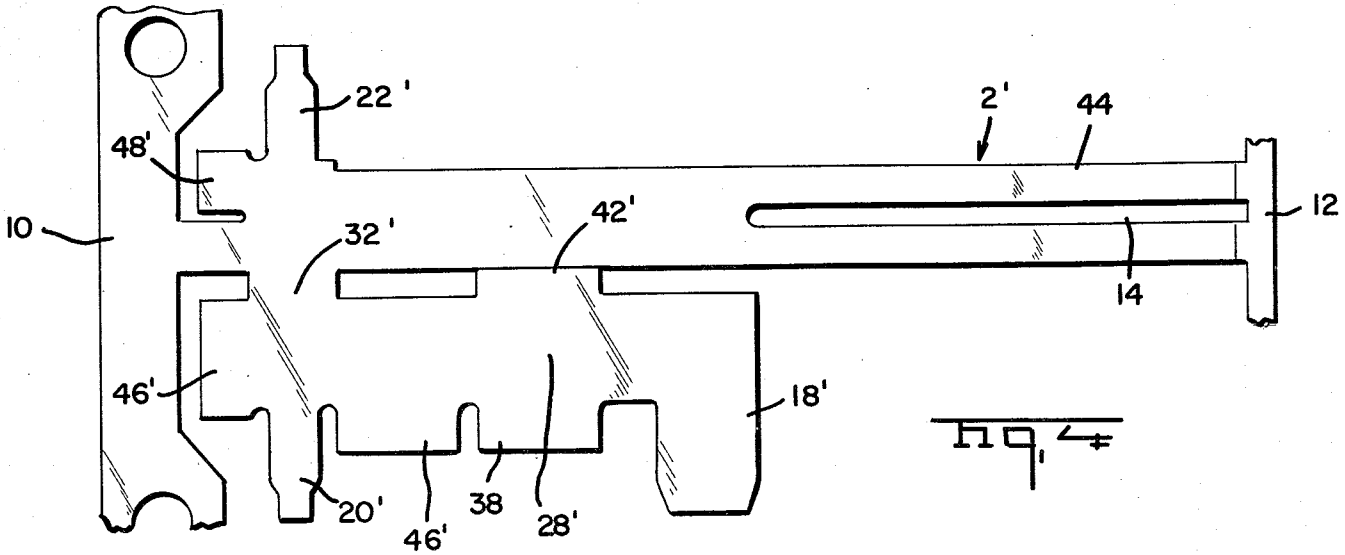
FIG. 4 is a plan view of a blank from which a spring contact, in accordance with the invention, is formed.

As previously mentioned, the continuous strip, shown in FIG. 1, is produced by conventional stamping and forming operations so that the strip can be fed from a reel to an insertion machine which has tooling for cutting off the carrier strips 10, 12 and inserting the individual spring contacts 2 into the circuit board. The blank from which the individual spring contacts are formed is shown in FIG. 4, and the same reference numerals, differentiated by prime marks, are used in FIGS. 1 and 4 to identify corresponding parts of the blank and of the finished contact. Thus it can be seen that the mounting pin 16 is produced from the blank portions 20', 22' and the flanges 38, 40 are produced upon bending of the blank portions 38', 40' laterally relative to the portion 28' of the blank.

FIG. 3 shows a plurality of spring contacts, in accordance with the invention, mounted in a circuit board 50 of a type used in a telephone selector mechanism. The three contacts 2 which are mounted on the left hand portion of the surface 52 of the circuit board are identical to the contacts shown in FIGS. 1 and 2, while the contacts **2*a* are similar to the contacts 2, but are mirror images thereof. As shown in FIG. 3, the mounting portions 16 of the contacts extend through openings 56 in the circuit board, while the support pin portions 18 extend through openings 58. Ordinarily the lower ends of the mounting pin portions 16 will be soldered to conductors 17 (FIG. 5) on the underside of the circuit board and the lower ends of the mounting pin portions 18 will be soldered to isolated metallized areas in order to secure a permanent mounting. As also shown in FIG. 3, the edges 49 are disposed against the surface 52 as are the downwardly facing surfaces of the flanges 38, 40**.

The end portions of the contact springs extend past contact pins 54 which are mounted in the circuit board and which are also soldered to conductors on the underside of the board. The extreme ends of the contacts are disposed against the surfaces of teeth 60 of a control member. These teeth extend from a common base through a rectangular opening 62 in the circuit board. This control member is normally biased leftwardly, as viewed in FIG. 3, by a spring 66 so that all of the contacts 2 are maintained out of engagement and are spaced from their associated terminal pins 54. The spring contacts **2*a* however, are normally engaged with their associated terminal pins 54*a*. Each time a selector switch is depressed, the control member is moved rightwardly in the direction of the arrow from the position shown so that the spring contacts 2 move into engagement with the pin 54 and the spring contacts 2*a* are moved away from their associated pins 54*a***.

Figure 5:
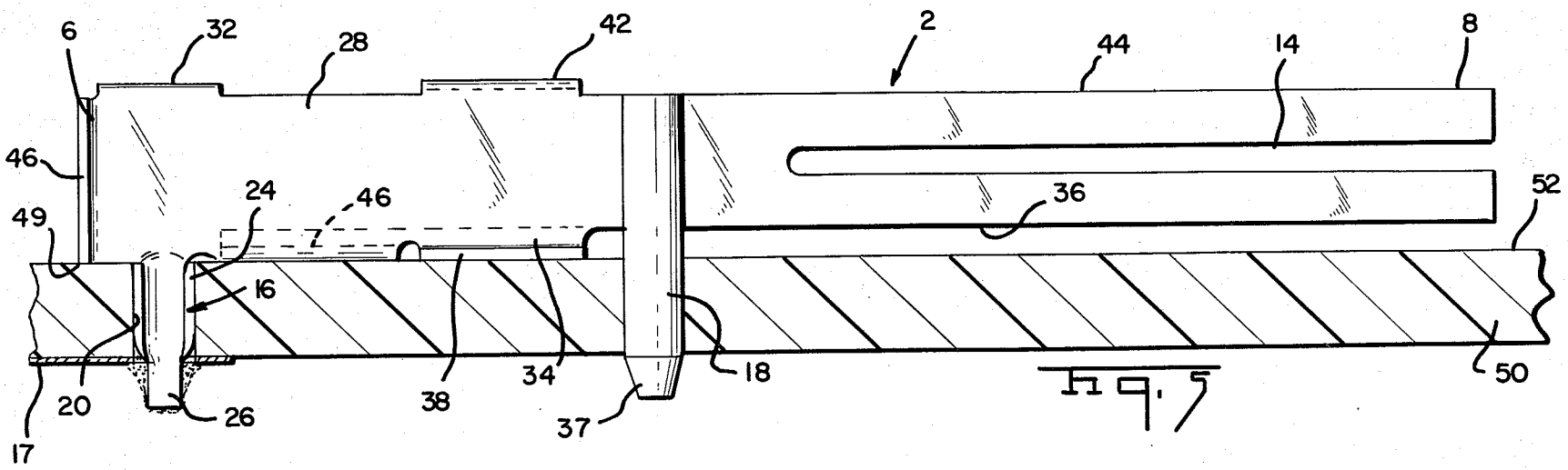
FIG. 5 is a side view of a spring contact mounted in a circuit board.

FIG. 5 is a side view of an individual contact spring positioned in the holes 56, 58 of a circuit board 50 and illustrates the manner in which the undersides of the flanges 38, 40 and the lower edges 49 of the flanges 46, 48 support the contact spring on the upper surface 52 of the circuit board. It can be seen from this figure that these surfaces of the flanges 38, 40 and the edges 49 of the flanges 46, 48 are coplanar and are against the surface of the board so that the centerline of the spring blade must extend parallel to the surface 52. The provision of these flanges and the provision of the upper flange 42 facilitates insertion of the individual spring contacts into the circuit board in that the insertion machine can be designed to impose a downward force as indicated by the arrows in FIG. 5 on the spring contact to drive it into the holes 56, 58. The flanges discussed above serve as stops when they move against the surface 52 so that the spring contact is precisely positioned on the board. Preferably, the mounting pin 16 and the support pin 18 are dimensioned to have a force fit in the holes 56, 58 so that the springs will be retained on the board until the soldering operation is carried out.

Figure 6:
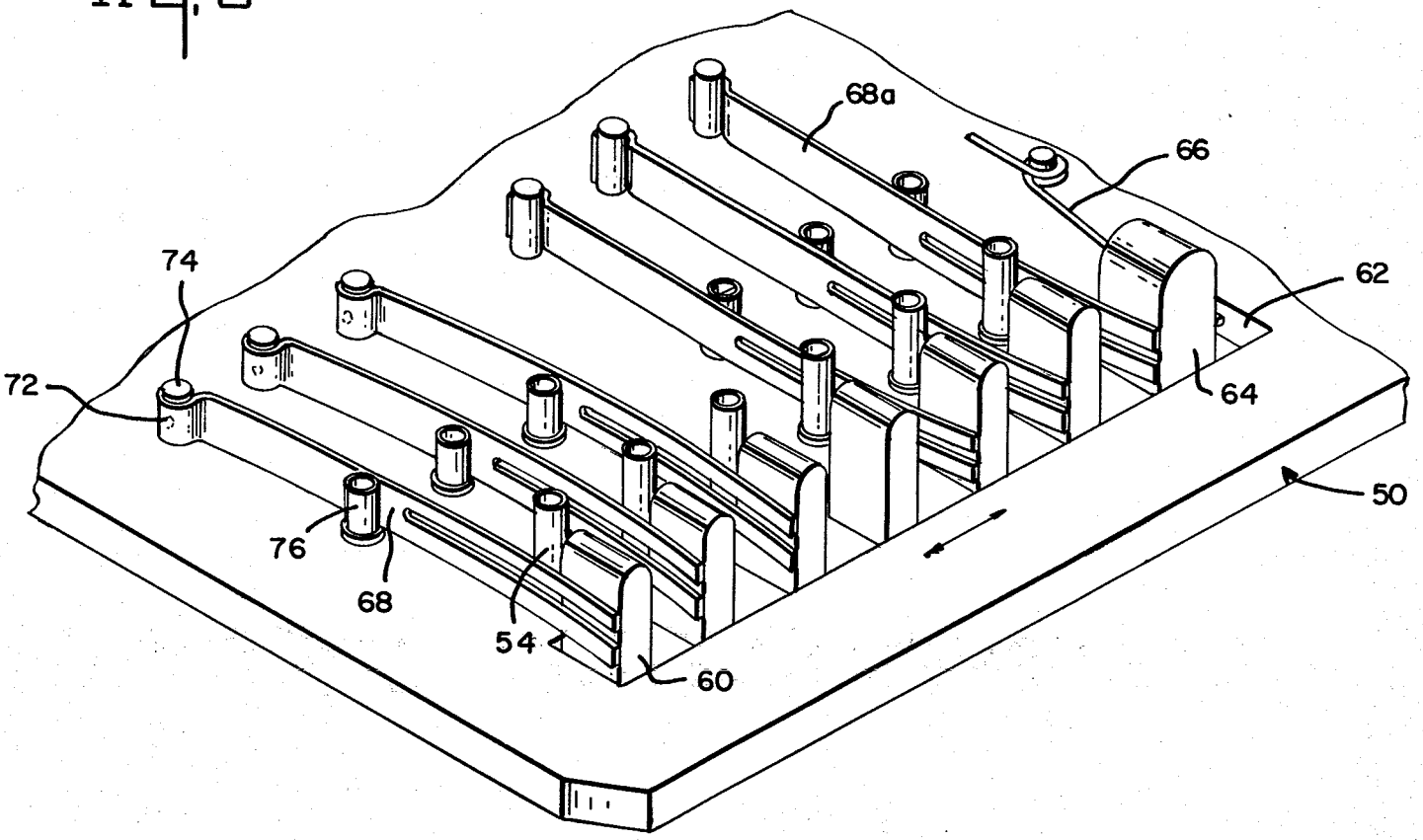
PRIOR ART Fig. 6
FIG. 6 is a view similar to FIG. 3, but showing prior art spring contacts mounted on the circuit board.

FIG. 6 shows the present type of spring mounted on a circuit board 50, as described above. In accordance with the present manufacturing practice, the springs **68, 68*a* are relatively simple elongated rectangular members which have semi-cylindrical end portions 72. These end portions extend around contact pins 74 and are secured by welding to these contact pins. The intermediate support for each spring blade is provided by a separate pin member 76 which is inserted through the circuit board. Springs of the type shown in FIG. 6 satisfy all of the rigid requirements of the telephone system as regards reliability and life expectancy however, each spring assembly requires three separate parts, a blade 68, and the pins 74, 76. Moreover, an assembly operation is required, in that, the spring blade 68 must be bonded to the post 74. Finally, assembly to the circuit board requires two separate insertion operations, the operation of inserting a support post 76 into the board and the operation of inserting the post 74** into the circuit board. By comparison, the spring in accordance with the instant invention is of one-piece unitary construction and is inserted into the circuit board in a single insertion operation.

What is claimed is:

1. A spring contact which is intended for insertion into a circuit board, said spring contact comprising:

an elongated spring blade having a mounting end and a free end, an integral mounting plate portion disposed beside and extending parallel to, said blade, said mounting plate portion extending from said mounting end partially along said blade towards said free end, said mounting plate portion and said blade being connected to each other by a connecting fold which is integral with adjacent edge portions of said mounting plate portion and said blade, an integral mounting pin means extending laterally from said spring contact at said mounting end, and a blade support pin integral with, and extending laterally from said mounting plate only, said support pin being spaced from said mounting pin whereby, upon insertion of said mounting pin and said support pin into spaced apart holes in a circuit board, said spring blade will extend across one surface of said circuit board in a plane which extends normally of said circuit board.

2. A spring contact as set forth in claim 1 having integral stop means for limiting the movement of said mounting pin and said support pin into holes in a circuit board whereby, after insertion, said blade will be located at a predetermined distance from said circuit board.

3. A spring contact as set forth in claim 2, said blade having an upper edge and a lower edge, said upper edge being remote from, and said lower edge being proximate to, said circuit board when pins are inserted into said holes, said stop means comprising flanges extending from said mounting plate portion adjacent to said lower edge.

4. A spring contact as set forth in claim 3, said mounting pin comprising aligned legs extending from said spring blade and said mounting plate portion.

5. A spring contact as set forth in claim 4, said support pin comprising a rolled portion of said mounting plate portion.

6. A spring contact which is intended for insertion into a circuit board, said spring contact comprising:

an elongated spring blade having a mounting end and a free end, said blade having an upper longitudinal edge and a lower longitudinal edge, said edges being respectively remote and proximate to the surface of a circuit board when said spring contact is mounted in said circuit board, an integral mounting plate disposed beside, and extending parallel to, said blade, said mounting plate extending from said mounting end partially along said blade towards said free end to an intermediate location, said blade and said mounting plate being connected to each other by an integral fold extending from said upper edge of said blade to adjacent edge portions of said mounting plate, said fold being adjacent to said mounting end of said blade, an integral mounting pin and an integral blade support pin, said mounting pin comprising aligned legs extending from said lower edge of said blade and from said mounting plate, said mounting pin being located at said mounting end, said blade support pin comprising a rolled end portion of said mounting plate, said blade support pin extending parallel to, and being spaced from, said mounting pin, support means for supporting said spring contact on a circuit board, said support means comprising supporting portions of said mounting plate which extend past said lower edge of said blade, said supporting portions having laterally extending flanges which extend normally of the plane of said blade in both directions, and a supporting flange for said blade comprising a flange extending from said mounting plate past a portion of said upper edge of said blade whereby, upon insertion of said mounting pin and said blade support pin into spaced-apart holes in a circuit board, said blade will be supported at a predetermined distance from the surface of said board by said support means, and said blade will be supported during flexure by said blade support pin.

7. A continuous strip of spring contact devices which are intended for mounting in a circuit board, said strip comprising:

a continuous carrier strip, said spring contact devices extending from said carrier strip at regularly spaced intervals, each of said spring contact devices comprising an elongated spring blade having an mounting end and an outer end, said blade being coplanar with said carrier strip and being integral with said carrier strip at said mounting end, a mounting pin portion and a support pin portion, said mounting pin portion being proximate to said carrier strip, said support pin portion being spaced from said carrier strip and being intermediate said ends, said mounting pin and support pin having parallel axes which extend parallel to said carrier strip, a mounting plate portion, said mounting plate portion extending parallel and adjacent to said spring blade and between said pins, said support pin being integral with said mounting plate portion, and a connecting fold which is integral with contiguous edge portions of said mounting plate portion and said spring blade, said connecting fold being disposed adjacent to said carrier strip and at said inner end of said blade whereby, upon removing one of said spring contact devices from said strip and inserting said pin portions into spaced-apart holes in a circuit board, an elongated cantilever spring is provided on said circuit board, said spring having a length substantially equal to the length of said blade minus the length of said connecting fold and said spring being supported upon flexure in one direction by said support pin.

8. A continuous strip as set forth in claim 7, said strip having a second carrier strip which extends parallel to said carrier strip, said outer ends of said spring contact devices being integral with said second carrier strip.

9. A continuous strip as set forth in claim 8, said support pin comprising a rolled portion of said mounting plate portion.

10. A continuous strip as set forth in claim 9, said mounting pin comprising aligned legs extending laterally from said spring blade and said mounting plate portion.

* * * * *